US012742288B2

(12) United States Patent
Paterson et al.

(10) Patent No.: US 12,742,288 B2
(45) Date of Patent: Sep. 22, 2026

(54) REFINER FILLING PIECE HAVING MULTIPLE COATINGS ON BARS

(71) Applicant: AIKAWA FIBER TECHNOLOGIES INC., Sherbrooke (CA)

(72) Inventors: Daniel Paterson, Sherbrooke (CA); Jens O. Heymer, Montreal (CA); Ronald J. Defoe, Becket, MA (US); Robert William Gooding, Montreal (CA)

(73) Assignee: AIKAWA FIBER TECHNOLOGIES INC., Sherbrooke (CA)

( * ) Notice: Subject to any disclaimer, the term of this patent is extended or adjusted under 35 U.S.C. 154(b) by 277 days.

(21) Appl. No.: 18/714,955

(22) PCT Filed: Dec. 7, 2022

(86) PCT No.: PCT/CA2022/000067
§ 371 (c)(1),
(2) Date: May 30, 2024

(87) PCT Pub. No.: WO2023/102642
PCT Pub. Date: Jun. 15, 2023

(65) Prior Publication Data

US 2025/0027271 A1 Jan. 23, 2025

(30) Foreign Application Priority Data

Dec. 7, 2021 (DE) ..... 102021132158.1

(51) Int. Cl.
*D21D 1/30* (2006.01)

(52) U.S. Cl.
CPC ..... *D21D 1/306* (2013.01)

(58) Field of Classification Search
CPC ..... D21D 1/30; D21D 1/306; B02C 7/12
See application file for complete search history.

(56) References Cited

U.S. PATENT DOCUMENTS 5,836,525 A * 11/1998 Garnier ..... D21D 1/306 241/296
5,868,330 A * 2/1999 Dodd ..... D21D 1/306 241/296

(Continued)

FOREIGN PATENT DOCUMENTS

AT 507724 A2 7/2010
CN 200940234 Y 8/2007

(Continued)

OTHER PUBLICATIONS

Translation of WO-2016169672.*

(Continued)

*Primary Examiner* — Bobby Yeonjin Kim
(74) *Attorney, Agent, or Firm* — Nicholas Mesiti, Esq.; Heslin Rothenberg Farley & Mesiti P.C.

(57) ABSTRACT

Disclosed is a refiner filling piece for a refiner having a rotor that rotates about an axis of rotation and cooperates with a stator to mechanically treat a pulp containing cellulosic fibers. The refiner filling piece is mountable to the rotor or the stator. The refiner filling piece comprises a base and a plurality of spaced-apart refiner bars, each refiner bar having a leading surface and a trailing surface. At least one of the refiner bars has a leading surface coated with a first coating and a trailing surface coating with a second coating. The first and second coatings have different chemical compositions and/or different physical properties. Alternatively, the first and second coatings may be applied to distinct portions of the same surface.

20 Claims, 13 Drawing Sheets

(56) References Cited

U.S. PATENT DOCUMENTS

| | | | | |
|---|---|---|---|---|
| 8,028,945 | B2 | 10/2011 | Gingras | |
| 2012/0119007 | A1 * | 5/2012 | Kallio | D21D 5/02 427/372.2 |

FOREIGN PATENT DOCUMENTS

| | | | | |
|---|---|---|---|---|
| DE | 69504490 | T2 | 5/1999 | |
| WO | 2010106220 | A1 | 9/2010 | |
| WO | WO-2016169672 | A1 * | 10/2016 | D21D 1/306 |

OTHER PUBLICATIONS

International Search Report and Written Opinion issued in PCT/CA2022/000067 and mailed Apr. 14, 2023.
Office Action issued in DE102021132158.1 dated Nov. 15, 2022.

* cited by examiner

REFINER FILLING PIECE HAVING MULTIPLE COATINGS ON BARS

CROSS REFERENCE TO RELATED APPLICATIONS

This application is the National Phase filing under 35 U.S.C. § 371 of International Application No.: PCT/CA2022/000067, filed on Dec. 7, 2022, which claims priority to German (DE) Application No.: 10 2021 132 158.1 filed on Dec. 7, 2021. The contents of the prior applications are hereby incorporated by reference herein in their entirety.

TECHNICAL FIELD

The present invention relates generally to a refiner filling of a refiner for papermaking and refining of lignocellulosic material in the manufacture of paper, paperboard, tissue, towel or fiberboard products and, more particularly, to the bars of the refiner filling.

BACKGROUND

A rotary-type pulp refiner, which may be a disc-type refiner or a conical refiner, uses a replaceable refiner filling composed of refiner filling pieces that are mounted to a rotor and a stator to mechanically shear and compress cellulosic fibres in a pulp suspension. The refiner filling pieces may be one-piece (unitary) components or segments that are assembled together. The refiner filling pieces have a plurality of refiner bars that perform the shearing and compressing actions on the cellulosic fibres in the pulp suspension.

In both disc-type and conical refiners, the presence of abrasives in the pulp suspension accelerates the wearing of the refiner bars of the refiner filling, thereby decreasing the depth of the grooves between adjacent bars. As a consequence, the refiner filling usually needs to be replaced fairly frequently. Typically, a refiner filling may have a service life of anywhere from 1 month to 2 years because the worn filling with shallower grooves can no longer provide adequate hydraulic capacity.

Although it is known to apply a uniform wear-resistant coating to the leading surface of the bars to prolong service life, this coating occupies a significant portion of the groove volume between the refiner bars which, in turn, can reduce the hydraulic capacity of the refiner filling. To achieve the desired hardness, these coatings are typically made of "exotic" alloys and are thus expensive. Hard coatings are by nature stiff and brittle which can lead to failure of the bars under severe operating conditions.

Accordingly, it is highly desirable to provide a new refiner bar technology that addresses at least some of the deficiencies of the prior art.

SUMMARY

In general, embodiments of the present invention provide a refiner filling piece and refiner in which the bars are coated with multiple coatings. In general, and as will be elaborated in greater detail below, the expression "multiple coatings" means that the leading and/or trailing surfaces have different coatings made of different chemical compositions and/or different physical properties. Alternatively, "multiple coatings" means that a particular surface of the bar has two or more different coatings having different chemical compositions and/or physical properties applied to distinct portions of the same surface.

An inventive aspect of the disclosure is a refiner filling piece for a refiner having a rotor that rotates about an axis of rotation and cooperates with a stator to mechanically treat a pulp containing cellulosic fibers. The refiner filling piece is mountable to the rotor or the stator. The refiner filling piece has a plurality of spaced-apart refiner bars. Each bar has a leading surface and a trailing surface. At least one of the refiner bars has a first coating on the leading surface and a second coating on the trailing surface. The first and second coatings have different chemical compositions and/or different physical properties. Alternatively, in another inventive aspect, the first and second coatings are applied to distinct, non-overlapping portions of the same surface. In other words, the first coating is applied to a first portion of the surface and the second coating is applied to a second portion of the same surface such that the first and second coatings are non-overlapping, i.e. applied to separate portions of the same surface.

The foregoing presents a simplified summary of the invention in order to provide a basic understanding of some aspects of the invention. This summary is not an exhaustive overview of the invention. It is not intended to identify essential, key or critical elements of the invention or to delineate the scope of the invention. Its sole purpose is to present some concepts in a simplified form as a prelude to the more detailed description that is discussed later. Other aspects of the invention are described below in relation to the accompanying drawings.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

Disclosed herein are various embodiments of a refiner filling piece having refiner bars at least one of which is coated with first and second coatings applied respectively to the leading and trailing surfaces or alternatively applied to distinct portions of the same surface. The present specification also discloses a refiner having one or more refiner filling pieces that include the refiner bars coated with the first and second coatings as described above.

Figure 1:
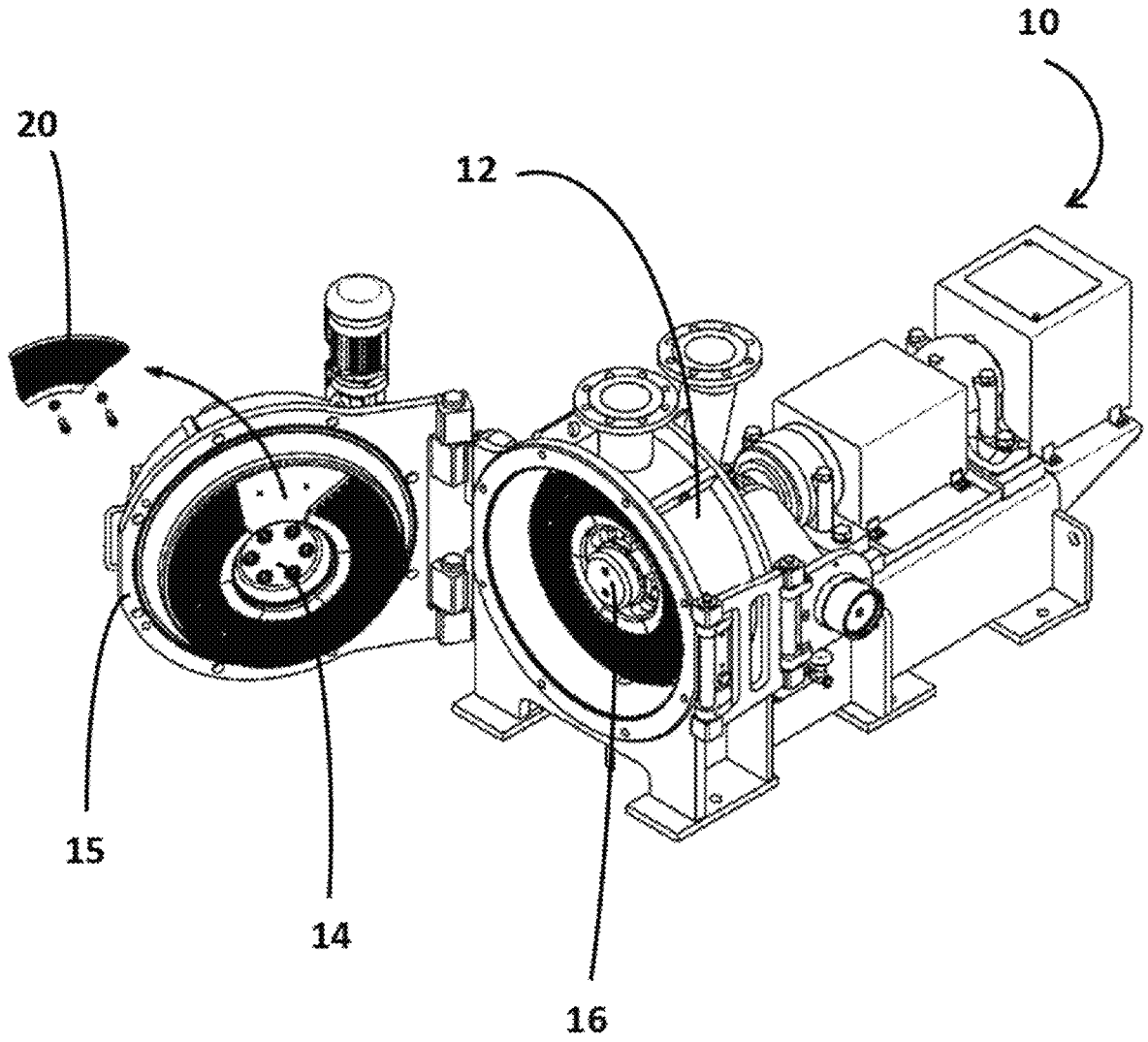
FIG. 1 is a perspective view of a refiner having a rotor and stator in accordance with an embodiment of the present invention showing the replacement of a refiner filling piece on the stator.

FIG. 1 is a perspective view of a refiner generally denoted by reference numeral 10 in accordance with one embodiment of the present invention. In the embodiment depicted in FIG. 1, the refiner 10 has a housing 12, a stator 14 and a rotor 16. The rotor rotates about an axis of rotation and cooperates with the stator to mechanically treat a pulp (or pulp suspension) containing cellulosic fibers. The axis of rotation defines an axial direction and a radial direction. In the illustrated embodiment of FIG. 1, the refiner is a disc-type refiner having a replaceable refiner filling. The refiner filling is composed of a plurality of refiner filling pieces. In the example of FIG. 1, the refiner filling pieces are segments of a generally flat, annular disc-like or plate-like structure (also referred to herein as a "plate"). However, it will be appreciated that the refiner filling pieces may be conical filling pieces in a conical refiner. For the purposes of this specification, the expression "refiner filling piece" shall be construed as encompassing a flat disc-like plate or an arcuate segment thereof, or a conical structure or an angular segment thereof. For a disc-type refiner, the refiner filling piece may be a one-piece circular plate, an annular plate or an arcuate segment that is assembled with other arcuate segments to form the complete circular or annular plate. Analogously, for a conical refiner, the refiner filling piece may be a one-piece conical (or frusto-conical) structure or an angular segment of a cone (or frustum) that is assembled with other such angular segments to form a complete conical (or frusto-conical) structure. From the foregoing, it is to be understood that a refiner filling piece may be circular, annular or conical (i.e. defining a complete 360-degree component) or segmented (i.e. defining an arcuate or angular component of less than 360 degrees that is designed to be assembled with other such segments to form the complete circular or annular plate or to form the cone, as the case may be).

FIG. 1 depicts the replacement of a refiner filling piece 20 on the stator 14. The refiner filling piece 20 may be mounted to the stator 14 using fasteners, e.g. threaded fasteners, as shown. In this example, a plurality of refiner filling pieces 20 are mounted to the stator 14 in an annular arrangement to constitute a stator-side refiner plate. In the embodiment depicted in FIG. 1, the stator 14 is mounted to a door-like cover 15 that pivots about a hinge mechanism to enable replacement of the refiner filling piece(s) 20.

Figure 2:
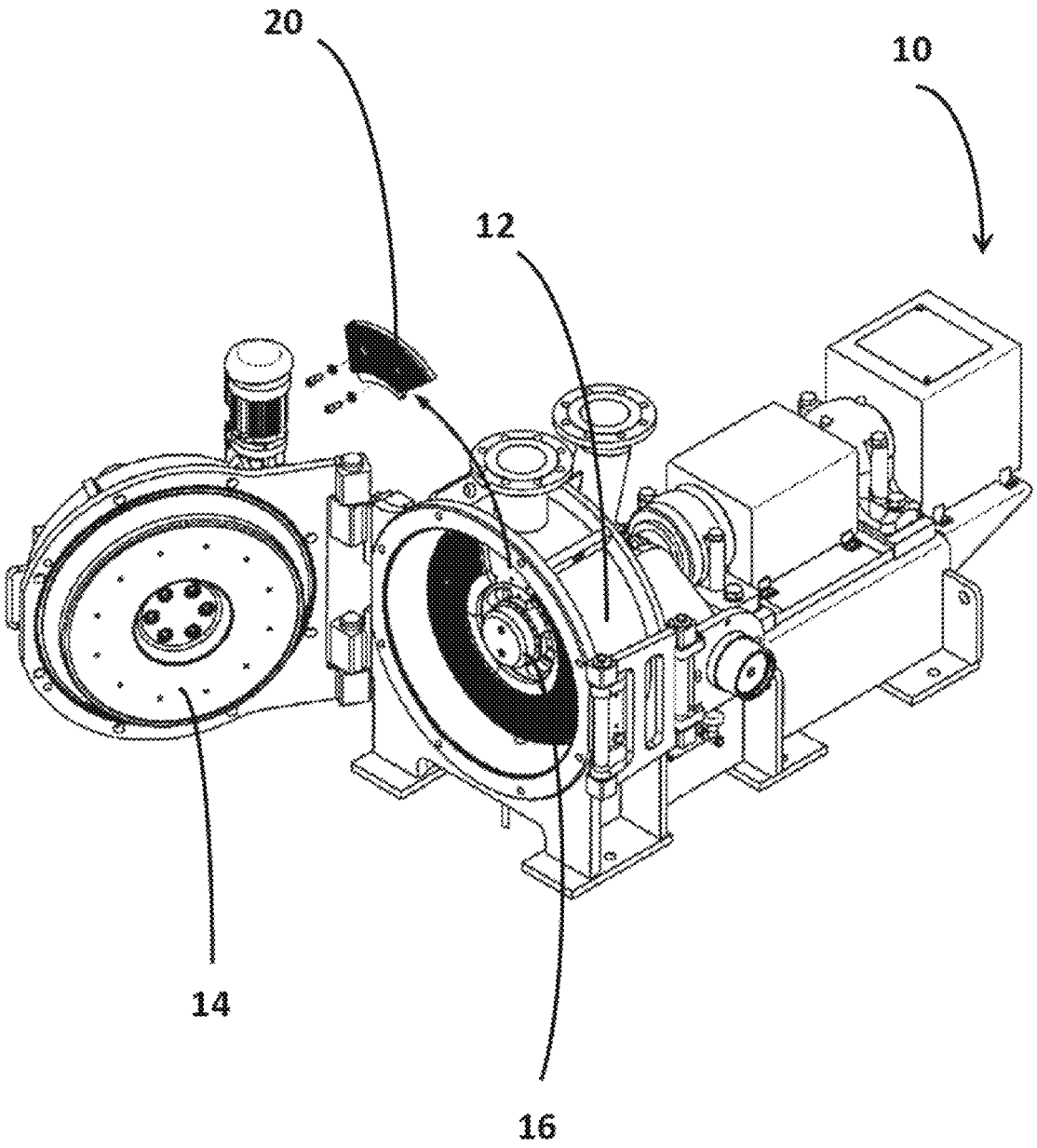
FIG. 2 is another perspective view of the refiner of FIG. 1 showing the replacement of a refiner filling piece on the rotor.

FIG. 2 is another perspective view of the refiner 10 of FIG. 1 showing the replacement of a refiner filling piece 20 on the rotor 16. The refiner filling piece 20 may be mounted to the rotor 16 using fasteners, e.g. threaded fasteners, as shown. A plurality of refiner filling pieces 20 are mounted to the rotor 16 in an annular arrangement to constitute a rotor-side refiner plate. In the embodiment depicted in FIG. 2, the rotor 16 is mounted inside the housing 12 of the refiner 10.

Figure 2A:
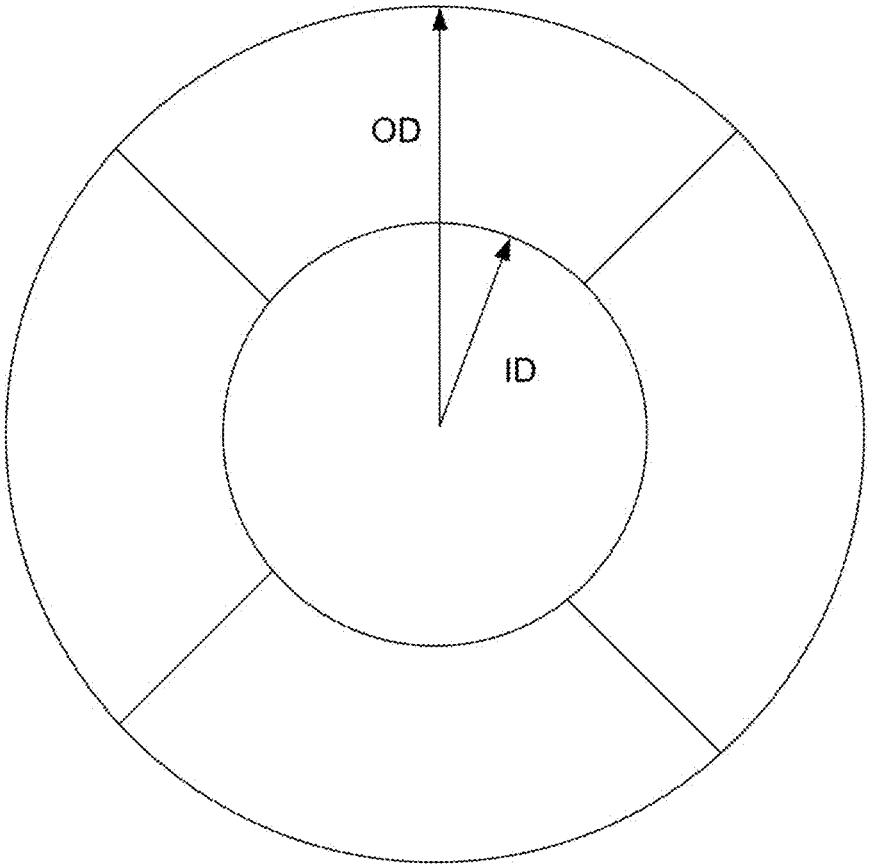
FIG. 2A is a plan view of four refiner filling pieces shaped as four arcuate segments as one example of segmented filling pieces for a disc-type refiner.

In the embodiment of FIGS. 1 and 2, the refiner filling piece 20 is a replaceable refiner filling piece having a segmented plate-like shape. When servicing the refiner, the refiner filling may be replaced, if worn, by replacing the assembly of refiner filling pieces that constitute the filling. For example, as shown in FIG. 2A, four refiner filling pieces shaped as four arcuate segments may be assembled to provide a complete annular plate structure for a disc-type refiner. The angular arc of each arcuate or segmented filling piece may be varied from what is shown in these examples. The angular arc of the filling piece may be, for example, 360 degrees, 180 degrees, 90 degrees, 45 degrees, 30 degrees, 22.5 degrees, 20 degrees, 15 degrees, 10 degrees, etc. so that when assembled they constitute an annular arrangement having a full 360 degrees. FIG. 2A also shows that the annular refiner filling piece may be characterized by an inner diameter (ID) and an outer diameter (OD). The refiner filling piece thus extends radially from the inner diameter to the outer diameter. It will also be appreciated that a complete plate or annulus of arcuate or segmented filling pieces may be composed of filling pieces of different shapes, e.g. one 180-degree filling plus two 90-degree filling pieces, two 90-degree filling pieces plus four 45-degree filling pieces, three 60-degree filling pieces plus six 30-degree filling pieces, and so on.

As illustrated in FIGS. 3-10, the refiner filling piece 20 has a base 22. The base may have a uniform thickness in an axial direction in some embodiments although it may alternatively have a non-uniform thickness. The base extends radially from an inner diameter ID to an outer diameter OD as depicted in FIG. 2A. The refiner filling piece 20 has a plurality of spaced-apart refiner bars 30 (also known as "blades"). The bars may be spaced apart with a uniform or non-uniform groove width, i.e. the spacing between adjacent bars may vary or be constant. Optionally, the refiner bars are spaced apart by spacers 24 although, in other implementations, there may be no spacers. Each bar is defined by a bar length BL extending toward the outer diameter, i.e. extending generally radially, and is defined by a bar height BH protruding generally axially from the base. The bar height may be constant or varying. In some implementations, the bar height may be, for example, a value that is within the range of 3 to 14 mm.

Figure 3:
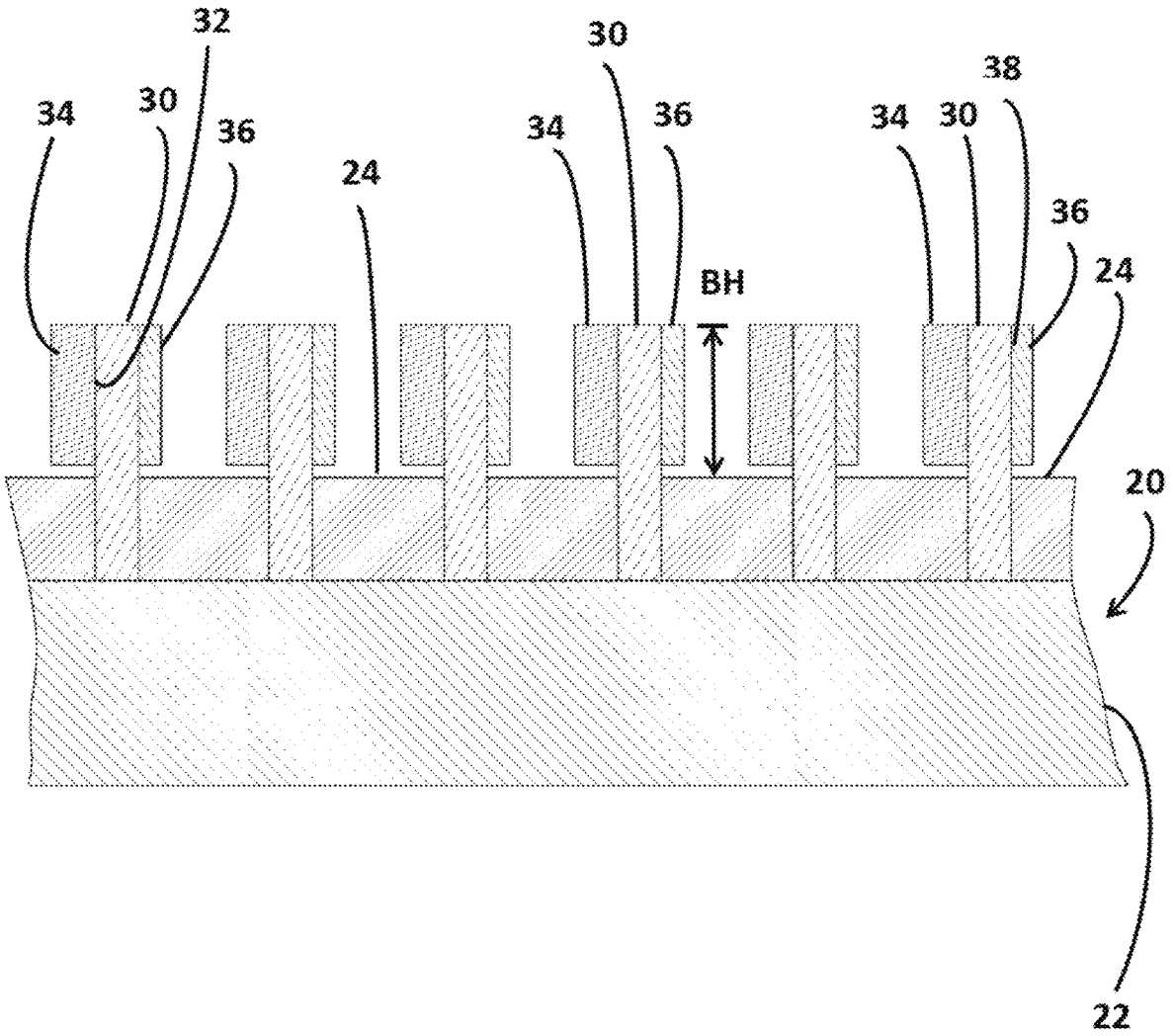
FIG. 3 is a cross-sectional view of a refiner filling piece having bars on which are applied a first coating on a leading surface and a second coating on a trailing surface, wherein the first and second coatings have different chemical compositions and/or physical properties.
Figure 4:
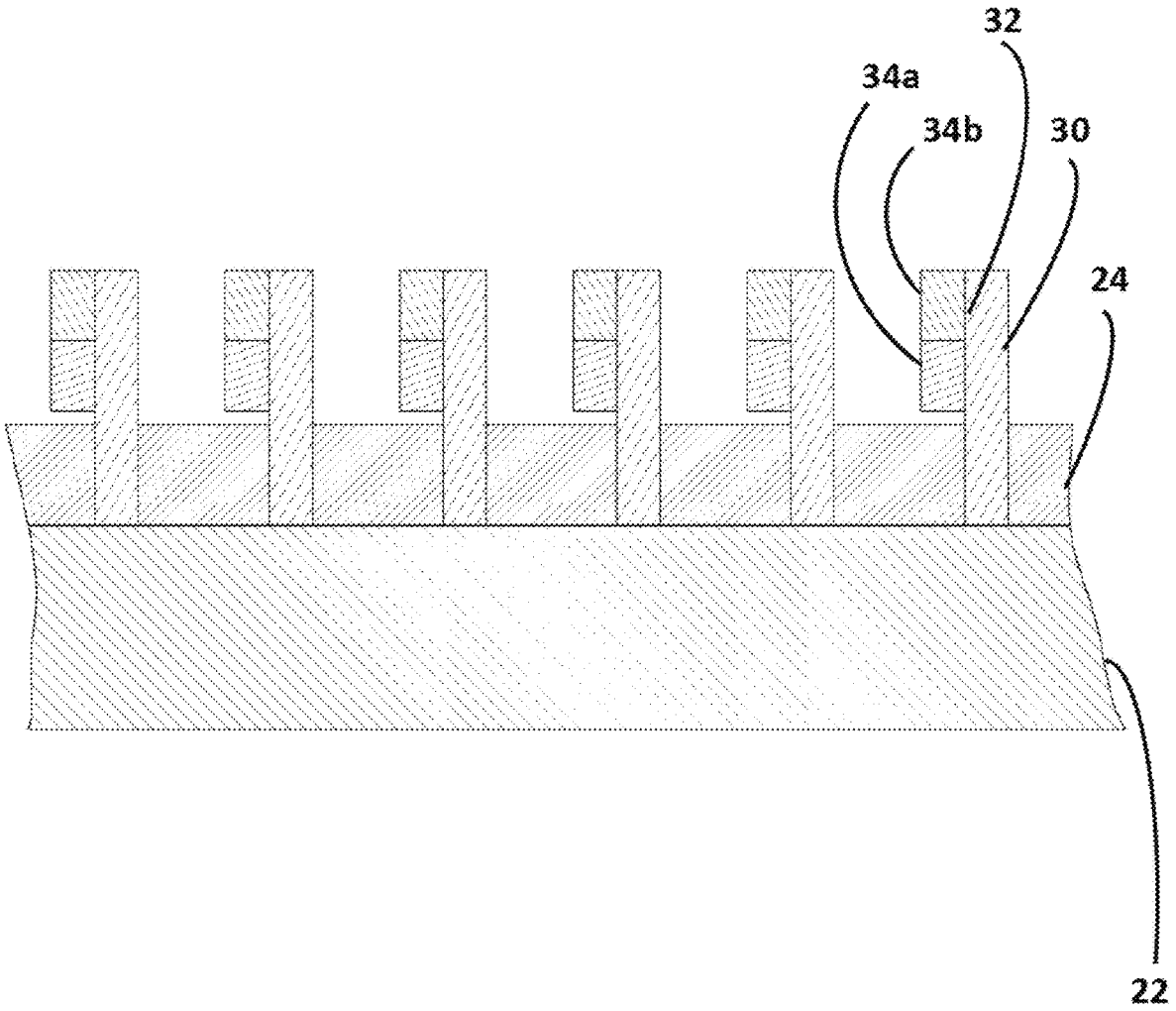
FIG. 4 is a cross-sectional view of a refiner filling piece having bars on which first and second coatings are applied to distinct and non-overlapping portions of the leading surface wherein the first and second coatings have different chemical compositions and/or physical properties.

In the embodiments depicted in FIGS. 3 and 4, the bars are coated with two different coatings, i.e. a first coating and a second coating. In these embodiments, the first coating and the second coating have different chemical compositions and/or different physical properties. In other words, the chemical composition and/or physical property of one coating is different from that of the other coating. For example, as shown in FIG. 3, the leading and trailing surfaces may have different coatings made of different chemical compositions and/or having different physical properties. As coatings may have some minor natural variations in a particular physical property or chemical composition through its coating thickness, it should be understood that, for the purposes of this specification, a difference in a physical property or chemical composition refers to a difference in the average, mean or nomimal value of the physical property or chemical composition of the coating. In other words, the average physical property over the coating cross-section may be understood as representing the nominal physical property of a particular coating. Different coatings having different physical properties are thus different, for example by more than 10%, in their respective average values for a particular physical property.

FIG. 3 is a cross-sectional view of a refiner filling piece 20 having bars 30, each having a leading surface 32 and a trailing surface 38. A first coating 34 is applied to the leading surface 32 of the bars 30 and a second coating 36 is applied to the trailing surface 38 of the bars 30. In this embodiment, the first coating 34 is composed of a first chemical composition and the second coating is composed of a second chemical composition that is different from the first chemical composition. Alternatively, in another embodiment, the first coating 34 and the second coating 36 have different physical properties, whether the coatings are of the same chemical composition or not.

For the purposes of this specification, a different chemical composition shall be understood to mean that the first chemical composition and the second chemical composition have different chemical formulae such that at least one physical property of the first chemical composition is at least 10% different from that of the second chemical composition.

A coating may be made of a single chemical compound or substance (having a single chemical composition) or it may be made of a plurality of compounds or substances. Each coating has a plurality of physical properties, e.g. mechanical, thermal and electrical properties. Physical properties include, but are not limited to, hardness, toughness or impact resistance, porosity, elasticity, ductility, wear resistance or erosion resistance, tensile strength, compressive strength, fatigue strength, corrosiveness, creep, and surface roughness.

Although the coatings may differ only with respect to a single physical property, the coatings may differ with respect to multiple physical properties.

In one specific embodiment, the first and second coatings are made of the same chemical composition (i.e. the first and second coatings have the same chemical formula) but have different physical properties as a result of heat treatment or different fabrication processes that result in different physical properties.

In one embodiment, the physical properties of the first and second coatings may differ by more than 50%. In another embodiment, the physical properties may differ by more than 25%. In yet another embodiment, the physical properties may differ by more than 10%. It will be appreciated that one physical property of the coating may differ by a certain amount whereas another physical property may differ by another amount. For example, the first coating may be 50% more ductile than the second coating, 30% more wear resistant than the second coating and 15% more impact resistant than the second coating.

In the embodiment depicted in FIG. 3, the first coating 34 has a coating thickness greater than the coating thickness of the second coating 36 as shown although in other embodiments the thickness of the first and second coatings may be equal or, alternatively, the second coating on the trailing surface may be thicker than the first coating on the leading surface. In FIG. 3, the coatings begin a small distance from the spacers 24 and extend to the full height BH of the bars. In other embodiments, the coatings extend over less than the full height BH of the bars 30 and/or may begin at different heights above the spacers 24 (or above the base 22 if there are no spacers 24). In one embodiment, the surface area of the first coating may be different from that of the second coating. In other embodiments, some sections of the bars may be coated on both sides, only on one side, or not coated on either side.

Figure 3A:
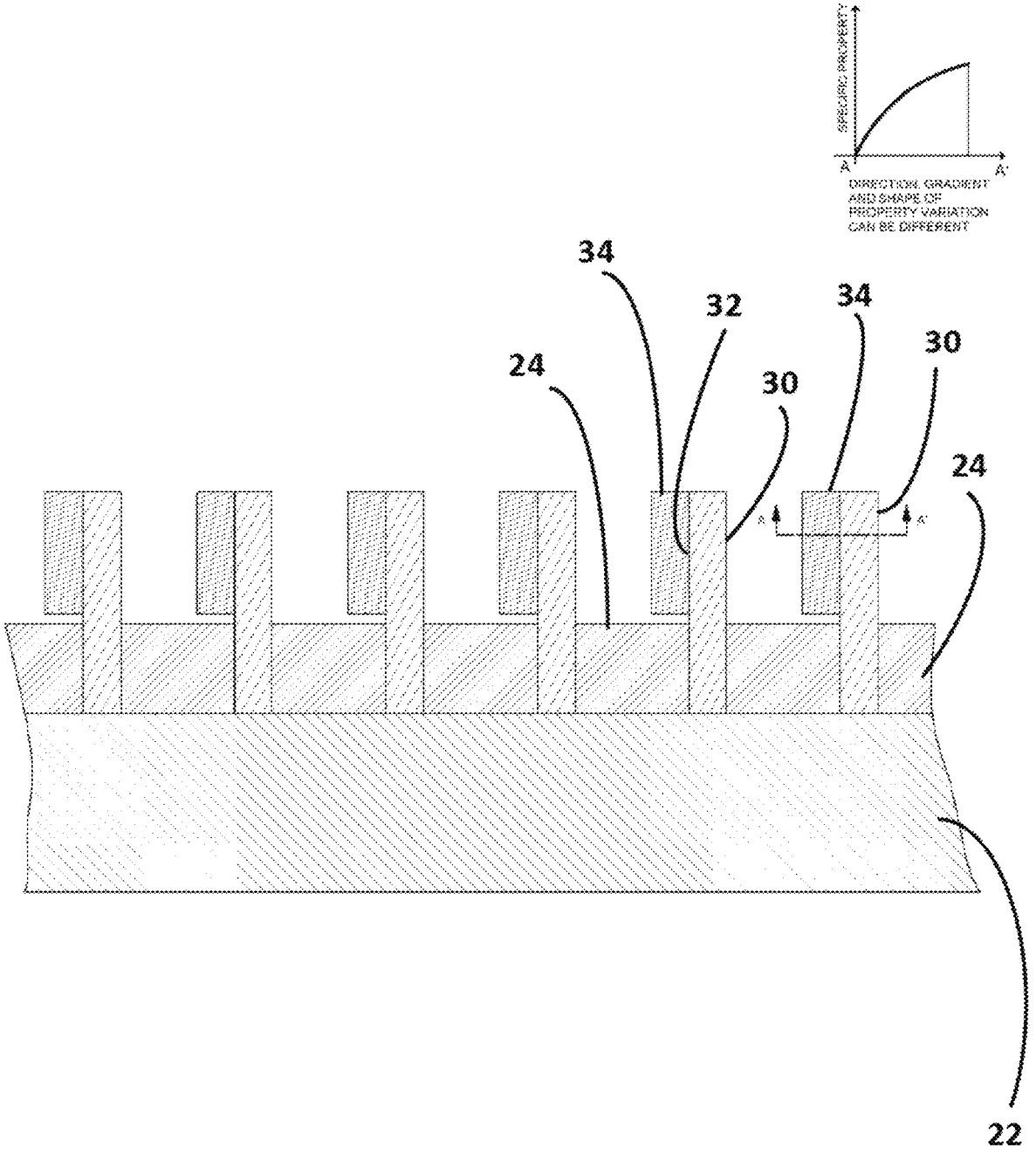
FIG. 3A is a cross-sectional view of a refiner filling piece having a variable-property coating on a leading surface of the bars in which the coating has a property that varies as a function of its thickness.

FIG. 3A depicts a variable-property coating 34 applied to only the leading surface 32 of the bars 30, i.e. there is no coating applied to the trailing surface although it will be appreciated that in a variant there may be a coating on the trailing surface. In this embodiment, the coating 34 has a physical property that varies as a function of thickness of the coating. In the graph shown in FIG. 3A, the variance is non-linear although the variance may be linear in other cases. The direction, gradient and shape of the property variation may also vary. The properties of the bars 30 themselves may also vary as a function of their thickness, either linearly or non-linearly. In one specific embodiment, the physical property varies by at least 10%.

In another embodiment, which is depicted in FIG. 4, a first coating 34*a* is applied to a first portion of a surface and a second (same-side) coating 34*b* is applied to a second portion of the same surface. The first coating 34*a* and the second coating 34*b* have different chemical compositions and/or different physical properties. In this example, the first and second portions of the surface are contiguous and adjacent and thus the first and second coatings 34*a*, 34*b* are also contiguous and adjacent. In a variant, there could be a small gap between the first and second coatings 34*a*, 34*b*. In this example, the first and second coatings are discrete, non-overlapping coatings applied on the same surface (e.g. leading surface 32) of the bar 30. In the embodiment depicted in FIG. 4, the first and second coatings 34*a*, 34*b* are applied to the leading surface 32 of the bars 30 and not to the trailing surface. However, it will be appreciated that in a variant the trailing surface may also have the first and second coatings as well. In the embodiment of FIG. 4, the first coating may be a lower coating on the leading surface and the second coating may be an upper coating on the leading surface (or vice versa). The lower coating is considered to be lower because it is closer to the spacer 24 and the base 22 than the upper coating. The first and second coatings on the same surface of the bar 30 may be side-by-side coatings, alternating strips of coatings, concentric coatings, or any other suitable arrangement, pattern or geometry of coatings.

Figure 5:
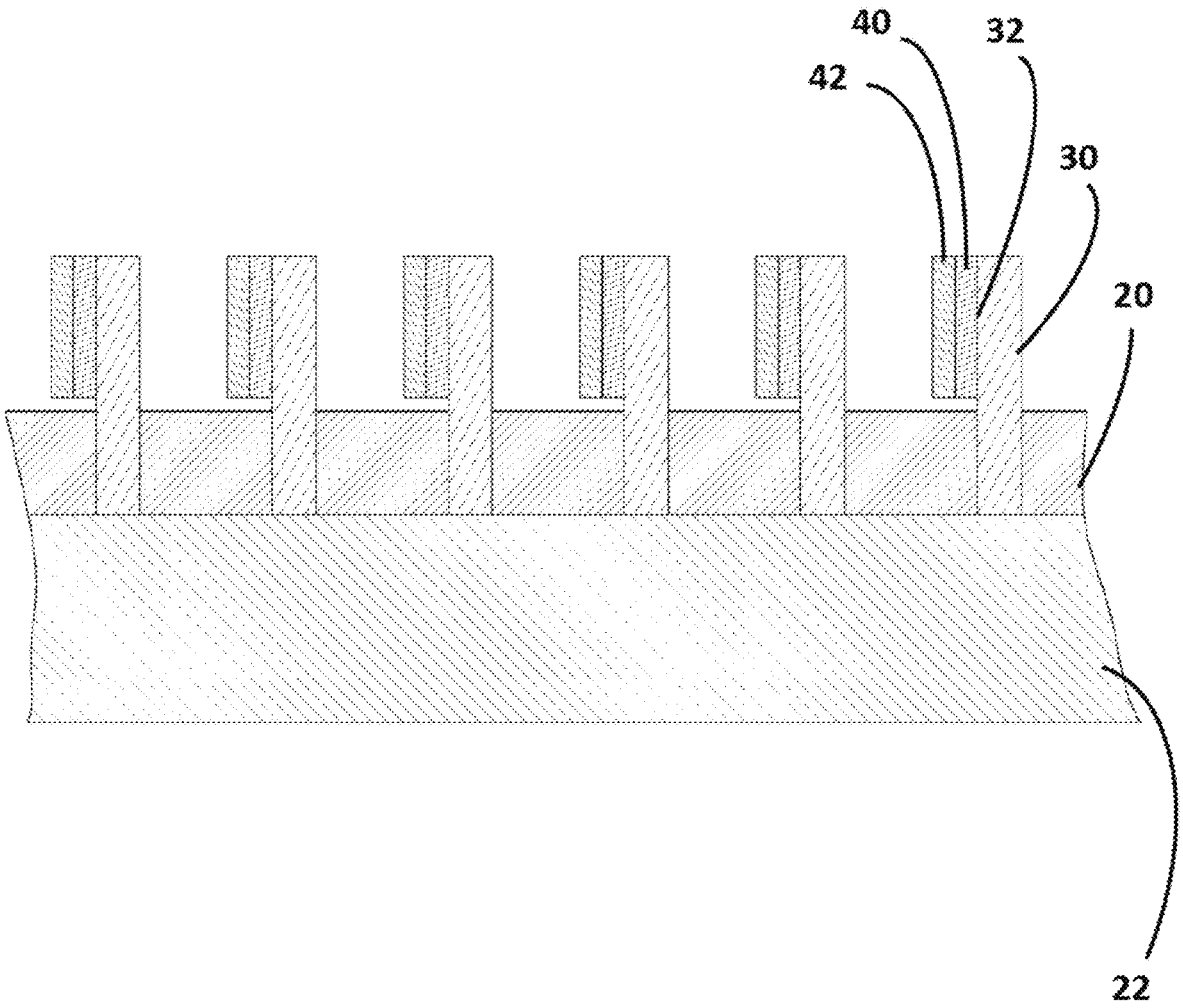
FIG. 5 is a cross-sectional view of a refiner filling piece having a variable-property coating on a leading surface of the bars, in which the variable-property coating comprises two layers having different chemical compositions and/or physical properties.

Illustrated in FIG. 5 is another example of a variable-property coating. In this example, the coating is composed alternatively of layers (i.e. coating layers). In FIG. 5, there are two layers, namely a first layer 40 and a second layer 42. As shown by way of example in FIG. 5, the first layer 40 is applied to the leading surface 32 of the bar 30. The second layer 42 is applied, as shown in this figure, to the first layer 40. In this example, the first and second layers 40, 42 have the same dimensions (e.g. same thickness and same vertical extent) although it will be appreciated that the first and second layers 40, 42 may have different dimensions, e.g. different thicknesses and/or different vertical extents. The first and second layers 40, 42 may have different chemical compositions and/or different physical properties. For example, the first layer 40 may be highly elastic to absorb impacts whereas the second layer may be highly wear-resistant to minimize wear or erosion. Although FIG. 5 shows only layers on the leading surface, the bar may have layers on the trailing surface as well or, alternatively only on the trailing surface.

Figure 6:
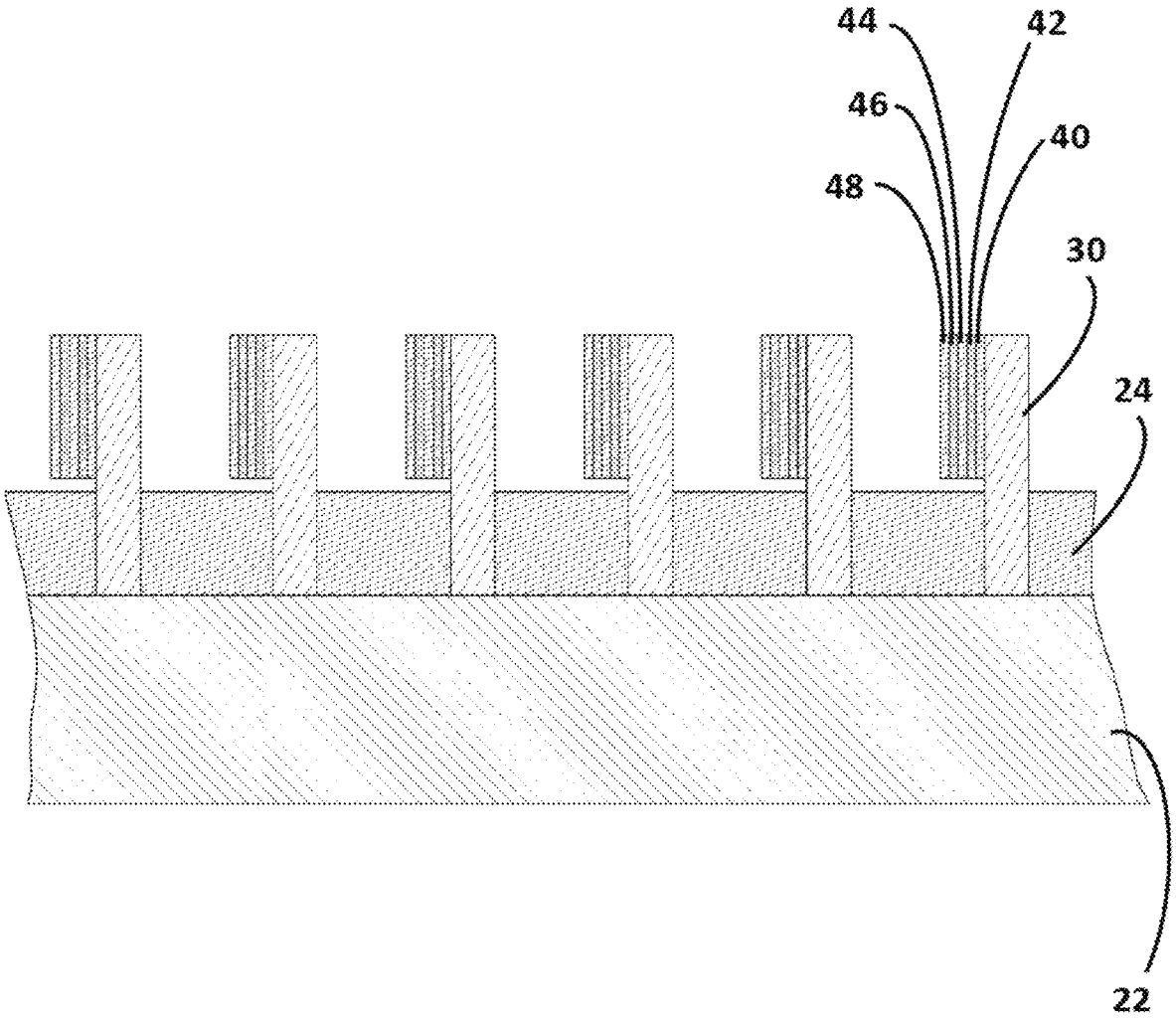
FIG. 6 is a cross-sectional view of a refiner filling piece having a variable-property coating on a leading surface of the bars, in which the variable-property coating comprises multiple alternating layers of two different chemical compositions and/or physical properties.

FIG. 6 is a cross-sectional view of a refiner filling piece in which the bars 30 are coated with a variable-property coating that comprises five layers, namely a first layer 40, a second layer 42, a third layer 44, a fourth layer 46 and a fifth layer 48. Although FIG. 5 depicts a coating having two layers and FIG. 6 depicts a coating having five layers, it will be appreciated that the number of layers may also be three, four, six, etc. In this example as shown in FIG. 6, the first layer 40, the third layer 44 and the fifth layer 48 are made of a first chemical composition and/or have a first set of physical properties whereas the second layer 42 and the fourth layer 46 are made of a second chemical composition and/or have a second set of physical properties. The variable-property coating of FIG. 6 is thus composed of alternating layers (i.e. layers having alternating chemical compositions and/or alternating physical properties).

Figure 7:
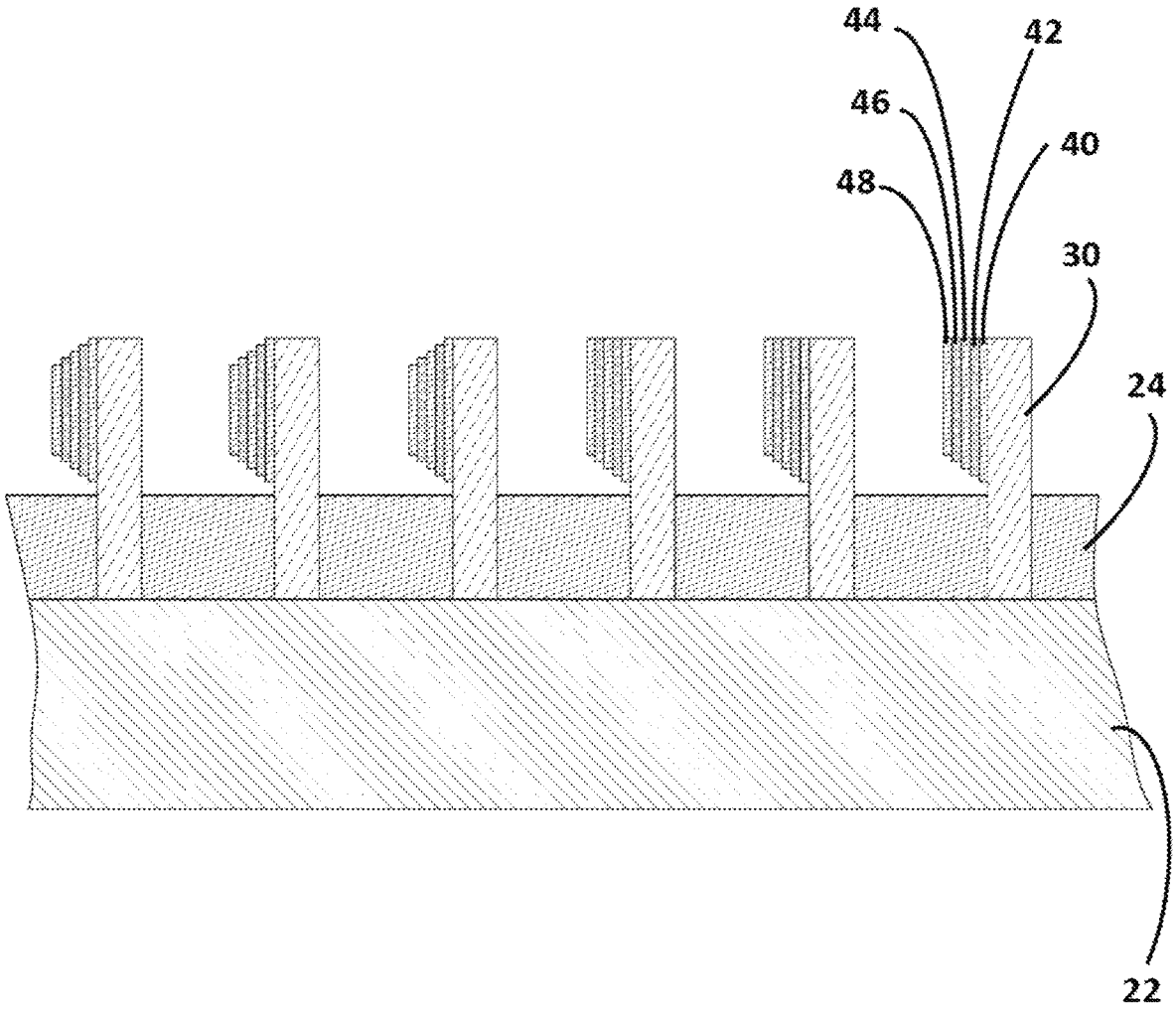
FIG. 7 is a cross-sectional view of a refiner filling piece having a variable-property coating on a leading surface of the bars, in which the variable-property coating comprises multiple alternating layers of two different chemical compositions and/or physical properties wherein the layers also extend to varying degrees over the height of the bar.

Although the layers 40-48 in FIG. 6 have the same dimensions, it is possible to provide a variable-property coating having layers of differing dimensions as depicted by way of example in FIG. 7. As shown in FIG. 6, the variable-property coating shown in FIG. 7 includes five layers of coatings applied successively to the leading surface of a bar 30. Specifically, in FIG. 7, each of the layers 40-48 has a different vertical extent. In this particular configuration, as shown, the first layer has the greatest vertical extent followed successively by the second, third, fourth and fifth layers. It will be appreciated that the layers as shown in both FIGS. 6 and 7 could alternatively be applied to the trailing surface of the bar instead of, or in addition to, being applied to the leading surface of the bar. It will also be appreciated that the leading and trailing surfaces could have different numbers and/or configurations of layers.

Figure 8:
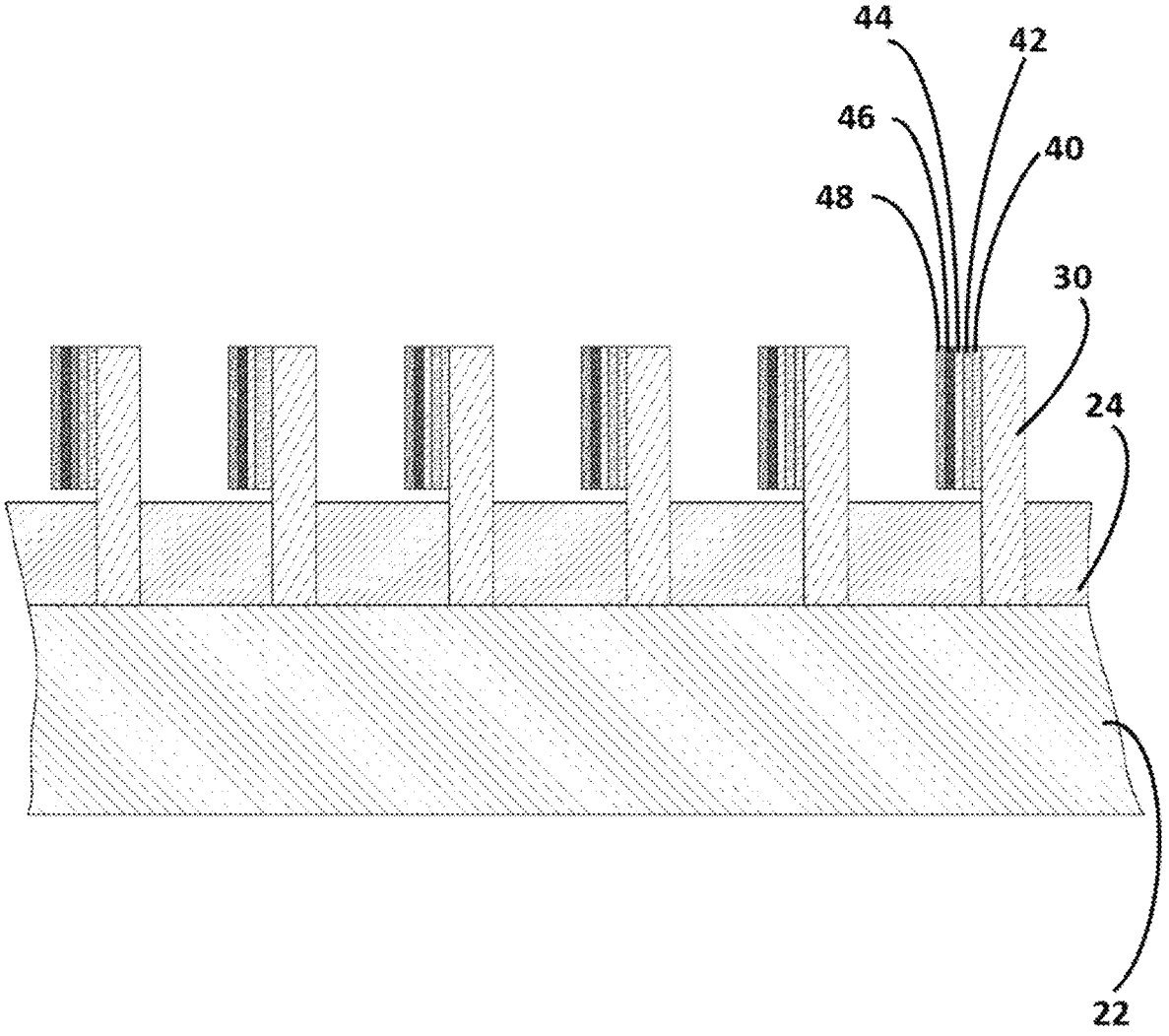
FIG. 8 is a cross-sectional view of a refiner filling piece having a variable-property coating on a leading surface of the bars, in which the variable-property coating comprises five layers of different chemical compositions and/or physical properties.

FIG. 8 illustrates a variable-property coating that comprises five different layers on the leading surface, namely a first layer 40, a second layer 42, a third layer 44, a fourth layer 46 and a fifth layer 48. The layers may be disposed on the trailing surface in a variant. Alternatively, the bar may have layers on both the leading and trailing surfaces. The bar may also be coated with different numbers of layers on the leading and trailing surfaces. In this example, each of the five layers may be made of a different chemical composition and/or have different physical properties.

In one embodiment, the different coatings may be formed of differently layered structures of coatings. For example, if a first coating has a first layer, second and third layer in that order, the second coating may be structured with a different order of layers, e.g. second layer, first layer and third layer, or third layer, first layer and second layer, etc. The first coating thus has a different layer structure than the second coating.

Figure 9:
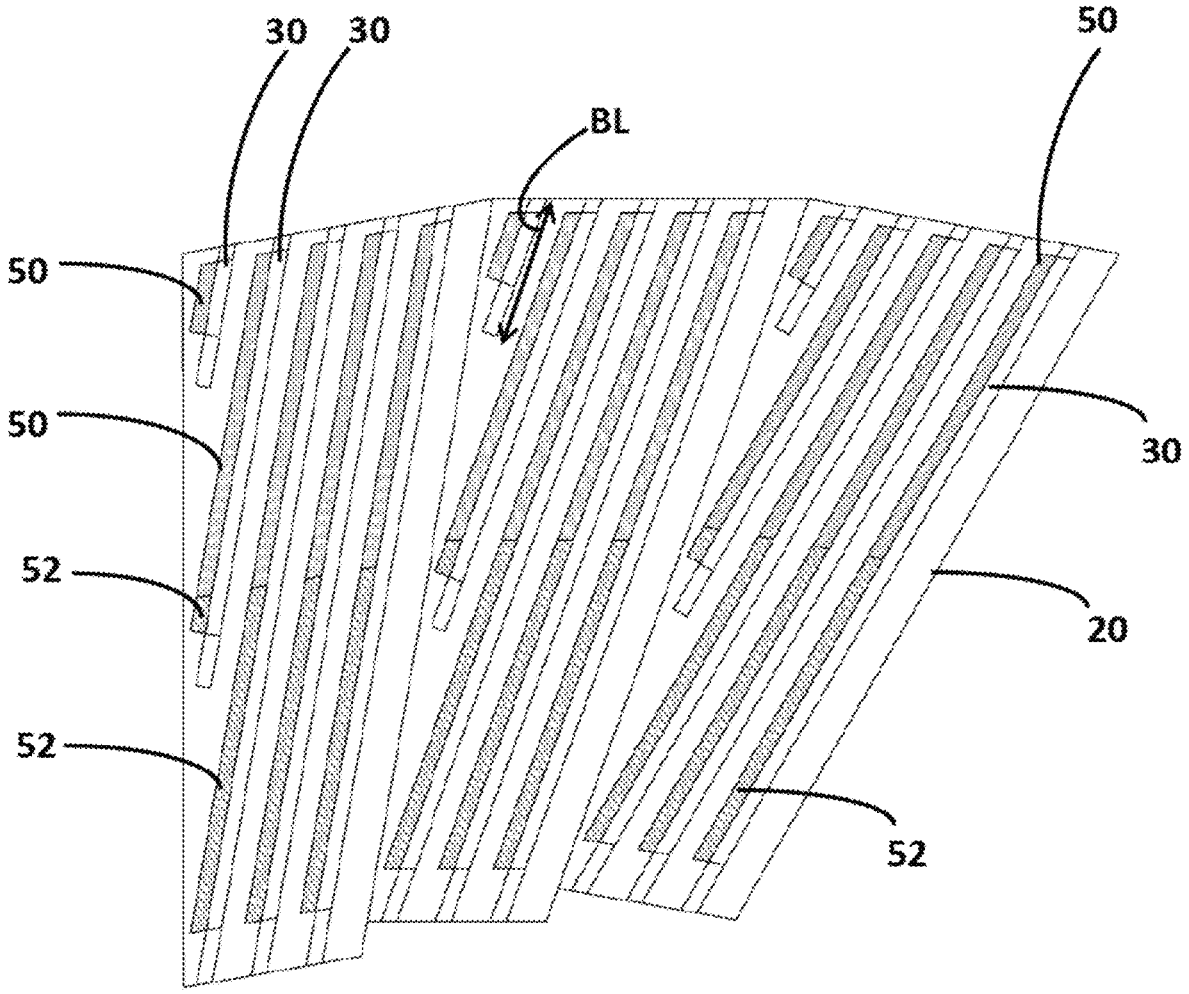
FIG. 9 is a top view of a refiner filling piece in accordance with another embodiment of the invention in which two different coatings are applied to two distinct radial portions of each leading surface of the bars.

FIG. 9 is a top view of a refiner filling piece 20 in accordance with another embodiment of the invention in which a first coating 50 and a second coating 52 are applied to distinct radial portions of the bars 30. As shown by way of example, the first and second coatings 50, 52 are applied along a bar length BL on the leading surface of the bars 30. The first coating 50 is applied to the radially outward portion of the bars whereas the second coating 52 is applied to the radially inward portion of the bars. The first and second coatings may be applied to the trailing surface instead of, or in addition to, the leading surface.

Figure 10:
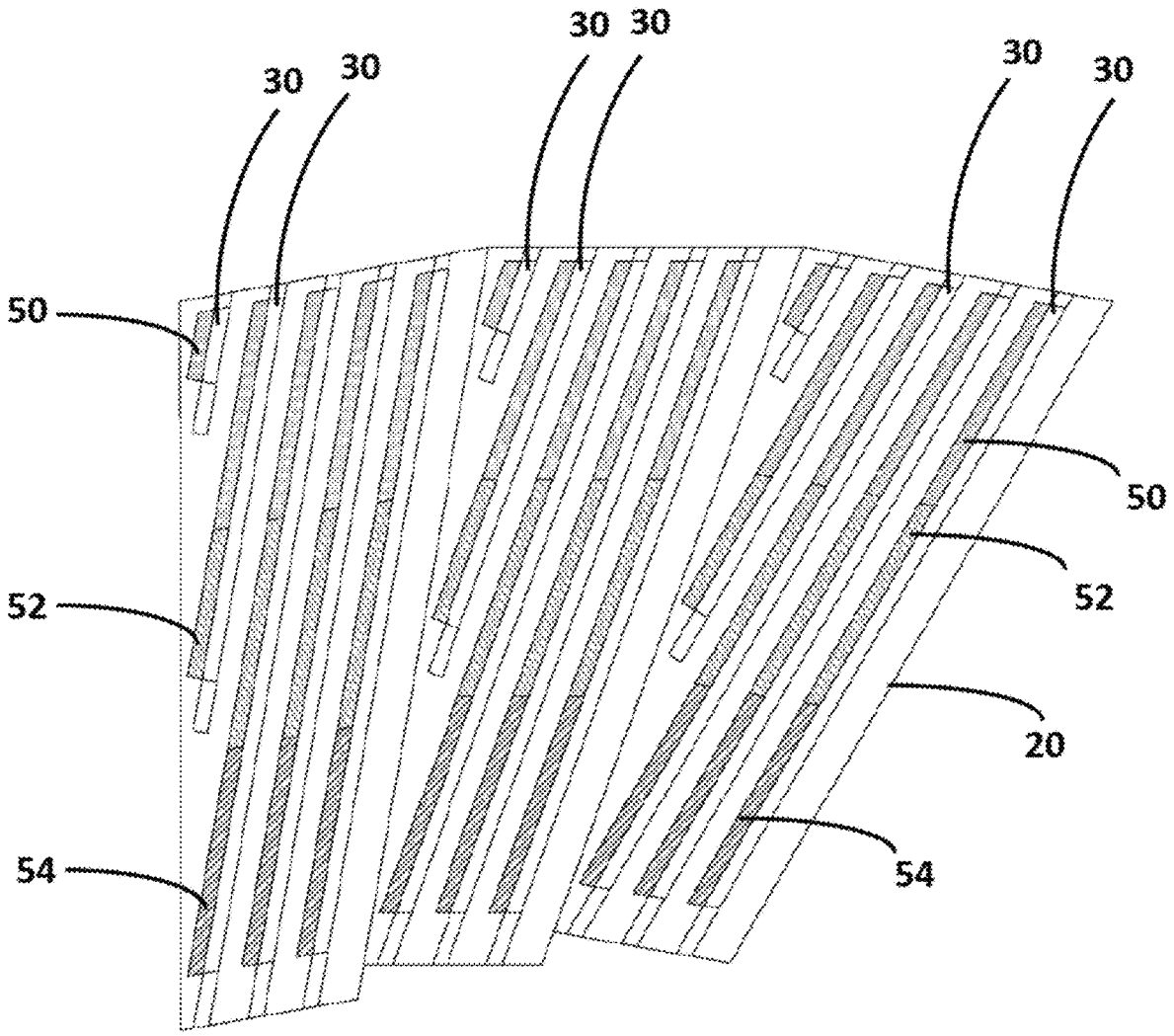
FIG. 10 is a top view of a refiner filling piece in accordance with another embodiment of the invention in which three different coatings are applied to three distinct radial portions of each leading surface of the bars.

FIG. 10 is a top view of a refiner filling piece 20 in accordance with another embodiment of the invention in which three coatings are applied to the leading surfaces of the bars. A first coating 50 is applied to the radially outward portion of the bars, a second coating 52 is applied to the radially middle portion of the bars, and a third coating 54 is applied to the radially inward portion of the bars. The first, second and third coatings 50, 52, 54 may be applied to the trailing surface instead of, or in addition to, the leading surface.

Although different coatings covering different radially distinct portions of the bars are illustrated in FIGS. 9 and 10, it will be appreciated that, in a variant, there may be transitional regions between one portion and an adjoining portion of a particular bar such that there is a gradual or progressive change in one or more coating properties or chemical composition instead of a discrete, stepwise change. The physical property or chemical composition for the first, second and third portions may be defined in terms of an average or mean value of a particular property or chemical composition. In one embodiment, the difference in the average or mean property between one coating and another coating along the radial length of the bar changes by a functionally significant amount, e.g. by an amount of 10% or more.

Figure 11:
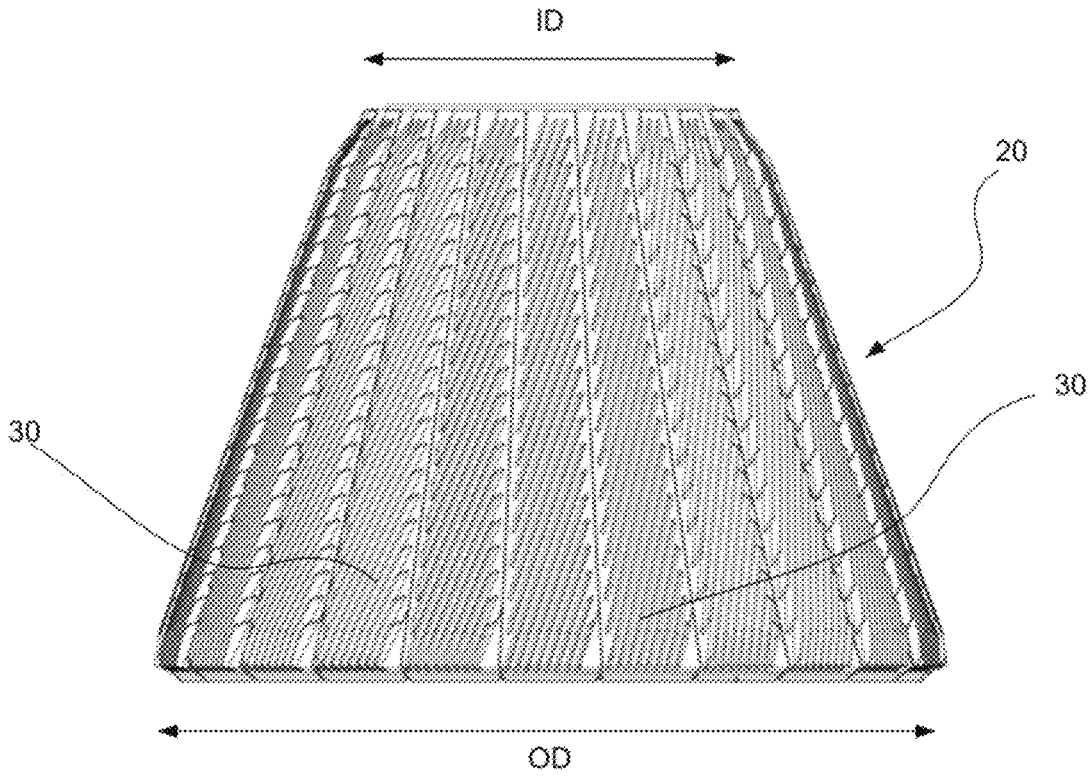
FIG. 11 depicts a conical refiner filling piece to which multiple coatings may be applied in accordance with another embodiment of the invention.

FIG. 11 depicts a conical refiner filling piece 20 to which multiple coatings may be applied in accordance with another embodiment of the invention. The conical refiner filling piece 20 is characterized by an inner diameter ID and an outer diameter OD as denoted in FIG. 11. The refiner bars 30 of the conical refiner filling piece 20 have two distinct coatings as described above which may vary in all of the different ways discussed above. In this example, the conical refiner filling piece 20 is a single unitary component defining the complete conical structure although it will be appreciated that the conical refiner filling piece may be a segmented conical filling piece that is assembled with other segmented conical filling pieces to constitute the complete conical (or frusto-conical) structure.

In some embodiments, the leading surface of all refiner bars has the dual coatings, i.e. all of the refiner bars are coated with the first and second coatings. In other embodiments, only some of the leading surfaces of the refiner bars have the first and second coatings. For example, an alternating pattern of coated and uncoated bars may be implemented. As another example, every third or fourth bar may be coated. Conversely, every third or fourth bar may be uncoated.

In some embodiments, the coatings extend along all of the bar length. In other embodiments, the coatings extend only partially along the bar length. For example, the coatings may extend over 90%, 80%, 70%, 60%, 50%, 40%, 30%, 20%, 10%, etc. of the bar length. As another example, one bar may be coated a first percentage with the next bar being coated a different percentage. In some embodiments, the coatings extend from the base to the top of the bar, i.e. the coatings cover all of the bar height. In other embodiments, the coatings extend only over a portion of the bar height. For example, the coatings may begin at a point higher than the base, e.g. the midpoint, at a quarter of the height, third of the height, fifth of the height, sixth of the height, eighth of the height, two-third of the height, three-quarters of the height, or any other point above the base. For example, the coating may begin at a point between a quarter of the height and the midpoint. In other words, in one embodiment, the coating may begin at a point above the base at a height of 20-45% of the height of the bar and then extend all the way to the top of the bar. In a more specific embodiment, the coating may begin at 20-35%, more preferably at 25-35%.

It will be appreciated that the coatings are manmade coatings that are intentionally applied to the surface(s) of the bar as opposed to a naturally occurring substance such as an oxide that may form on the surface(s) of the bar as a result of a naturally occurring phenomenon such as oxidation. In at least some embodiments, each coating has a thickness of at least 100 microns. In some embodiments, the coating has a thickness of at least 100 microns but not greater than 1 mm.

For the purposes of interpreting this specification, when referring to elements of various embodiments of the present invention, the articles "a", "an", "the" and "said" are intended to mean that there are one or more of the elements. The terms "comprising", "including", "having", "entailing" and "involving", and verb tense variants thereof, are intended to be inclusive and open-ended by which it is meant that there may be additional elements other than the listed elements.

This invention has been described in terms of specific embodiments, implementations and configurations which are intended to be exemplary only. Persons of ordinary skill in the art will appreciate that many obvious variations, refinements and modifications may be made without departing from the inventive concept(s) presented in this application. The scope of the exclusive right sought by the Applicant is therefore intended to be limited solely by the appended claims.

The invention claimed is:

1. A refiner filling piece for a refiner having a rotor that rotates about an axis of rotation and cooperates with a stator to mechanically treat a pulp containing cellulosic fibers, the refiner filling piece being mountable to the rotor or the stator, the refiner filling piece comprising:

a base;

a plurality of spaced-apart refiner bars, each refiner bar having a leading surface facing in the direction of rotation and a trailing surface; and wherein the leading surface of at least one of the refiner bars has a first coating on at least a portion of the leading surface and wherein the trailing surface of at least one of the refiner bars has a second coating on at least a portion of the trailing surface, wherein the first coating and the second coating have different chemical compositions or different physical properties.

2. The refiner filling piece of claim 1 wherein all of the refiner bars have the first coating and the second coating.

3. The refiner filling piece of claim 1 wherein the physical properties differ by at least 10%.

4. The refiner filling piece of claim 1 wherein the first coating is thicker than the second coating.

5. The refiner filling piece of claim 1 wherein the first coating on the leading surface is spaced above the base by a first distance and the second coating on the trailing surface is spaced above the base by a second distance that is different from the first distance.

6. The refiner filling piece of claim 1 wherein the first coating has a greater surface area than the second coating.

7. The refiner filling piece of claim 3 wherein the first coating is thicker than the second coating.

8. A refiner filling piece for a refiner having a rotor that rotates about an axis of rotation and cooperates with a stator to mechanically treat a pulp containing cellulosic fibers, the refiner filling piece being mountable to the rotor or the stator, the refiner filling piece comprising:

a base;

a plurality of spaced-apart refiner bars, each refiner bar having a surface; and wherein the surface of at least one of the refiner bars has a first coating on a first portion of the surface and a second coating on a second portion of the surface, wherein the first coating and the second coating are non-overlapping facing in the direction of rotation and have different chemical compositions or different physical properties.

9. The refiner filling piece of claim 8 wherein the surface is the leading surface.

10. The refiner filling piece of claim 8 wherein the surface is the trailing surface.

11. The refiner filling piece of claim 8 wherein all of the refiner bars have the first coating and the second coating.

12. The refiner filling piece of claim 8 wherein the physical properties differ by at least 10%.

13. The refiner filling piece of claim 8 wherein the first coating is applied to a radially outward portion of the surface and a second coating is applied to a radially inward portion of the surface.

14. The refiner filling piece of claim 8 further comprising a third coating on the surface, wherein the first coating is applied to a radially outward portion of the surface, a second coating is applied to a radially middle portion of the surface, and a third coating is applied to a radially inward portion of the surface.

15. The refiner filling piece of claim 8 wherein the first portion on which the first coating is applied is located at a greater height from the base than the second portion of the surface on which the second coating is applied.

16. The refiner filling piece of claim 8 wherein the first portion on which the first coating is applied has a greater surface area than the second portion on which the second coating is applied.

17. The refiner filling piece of claim 8 wherein the first coating is thicker than the second coating.

18. A refiner comprising:

a housing;

a stator supported within the housing;

a rotor that rotates about an axis of rotation and cooperating with the stator to mechanically treat a pulp containing cellulosic fibers;

a first refiner filling piece as defined in claim 1 fastened to the rotor; and/or a second refiner filling piece as defined in claim 1 fastened to the stator.

19. The refiner filling piece of claim 4 wherein the first coating on the leading surface is spaced above the base by a first distance and the second coating on the trailing surface is spaced above the base by a second distance that is different from the first distance.

20. The refiner filling piece of claim 19 wherein the first coating has a greater surface area than the second coating.

* * * * *